United States Patent [19]

Duchemin

[11] Patent Number: 4,973,929

[45] Date of Patent: Nov. 27, 1990

[54] SAFETY DEVICE FOR A SWITCHING APPLIANCE FORMED BY ASSEMBLING TOGETHER SEVERAL REMOVABLE MODULAR ELEMENTS

[75] Inventor: Pierre Duchemin, Fourqueux, France

[73] Assignee: Telemecanique, France

[21] Appl. No.: 426,910

[22] Filed: Oct. 26, 1989

[30] Foreign Application Priority Data

Oct. 27, 1988 [FR] France ..... 88 14016

[51] Int. Cl.[5] ..... H01H 67/02

[52] U.S. Cl. ..... 335/132; 335/202

[58] Field of Search ..... 335/131-3, 335/202; 200/293, 307

[56] References Cited

U.S. PATENT DOCUMENTS 4,644,308 2/1987 Guery et al. ..... 335/132

4,803,587 2/1989 Fournier et al. ..... 335/132

*Primary Examiner*—Leo P. Picard

*Assistant Examiner*—Lincoln Donovan

*Attorney, Agent, or Firm*—William A. Drucker

[57] ABSTRACT

The invention provides a safety device for switching appliances formed by the assembly of at least two removable modular elements, namely a switching module and an indirect switching control module which is able to pass from a tripped condition to a set condition by means of a setting member, tripping following a tripping order applied to a tripping member. The control module is fixed to the switching module by means of a screw whose head is only accessible in the set condition of the control module.

10 Claims, 2 Drawing Sheets

STOP

AUTO

TRIPPED

SETTING

SAFETY DEVICE FOR A SWITCHING APPLIANCE FORMED BY ASSEMBLING TOGETHER SEVERAL REMOVABLE MODULAR ELEMENTS

BACKGROUND OF THE INVENTION

1. Field of the Invention

The invention relates to a safety device intended for a switching appliance formed by assembling together several removable modular elements.

2. Description of the Prior Art

It concerns more particularly, but not exclusively, a switching appliance of a type similar to that described in the U.S. Pat. No. 84 14826 filed in the name of the Applicant, which includes :

switching module comprising one or more switches each having at least one fixed contact element, at least one mobile contact element, mounted on a mobile assembly so as to be able to take up at least two positions, namely a first position in which the mobile contact element is applied against the fixed contact element (closed condition) and a second position in which the mobile contact element is moved away from the fixed contact element (open condition) and resilient means exerting on the mobile assembly a force tending to bring the mobile contact element back into the first position, a direct switching control module such, for example, as an electromagnet adapted to cause a change of condition of the switch by exerting on the mobile assembly an action antagonistic to that of the resilient means, an indirect switching control module having at least two stable conditions, namely a set condition and a tripped condition, as well as two transitory phases, namely a manual setting phase and a tripping phase, this module comprising means adapted for accumulating a given amount of potential energy during the setting phase and tripping means for applying this potential energy on a member actuating the mobile assembly of the switch during the tripping phase in response to a tripping order, and a protection module adapted to emit the tripping order, for example following an overload or a current surge.

An important advantage of this type of appliance is that it is possible to remove or fit the control modules on the switching module without having to disconnect the circuit in which this latter is connected.

Now, for obvious safety reasons, these operations must necessarily take place without causing a change of condition of the switch and, preferably, in the open condition of the switch.

This means then that the direct switching module is in the de-energized condition and can then not exert a closure action of the mobile assembly of the switch and, moreover, the indirect switching module is in the set condition.

SUMMARY OF THE INVENTION

The object of the invention is then more particularly to provide a safety device which makes any fitting or any removal of the control modules impossible when the switch is not in a given condition (for example the open condition).

It provides then a safety device for an appliance of said type comprising a switching module on which is fixed a direct action control module by means of a screw mounted axially slidable in a through passage formed in said control module so that in the assembled position of this control module on the switching module, it may be screwed into a coaxial tapped bore provided in the switching module and that at the end of screwing the control module is clamped against the switching module through the action of the head of the screw on a bearing surface integral with the control module.

According to the invention, this device is more particularly characterized in that it comprises means adapted for preventing access to the head of the screw and, consequently, any possibility of screwing in or screwing out, when the control module is not in the set condition.

Advantageously, these prevention means may consist of a prevention element fast with the manual control member provided for setting the indirect switching control module.

Furthermore, the length of the threaded end of the screw screwed into said tapped bore will preferably be provided at least equal to the stroke of the mobile assembly of the switching module. In this case, said prevention means will be designed so as to cause, in cooperation with said stop, axial blocking of the screw (by imprisonment of the head).

With this arrangement, then, an attempt to assemble a control module in the tripped condition on a switching module cannot generate an action on the mobile assembly of this switching module, because of the presence of the threaded end of the screw which projects outwardly from the control module. In fact, this threaded end will prevent any possibility of contact of the actuating means of the control module on the mobile assembly.

This safety measure will be increased through the use of guide means associated with the switching module and with the control module so that these two modules can only be assembled together after a relative translational movement parallel to the axis of the screw, over a distance at least equal to the length of the end of the screw which projects outwardly from the control module, when the head of the screw is in contact with its bearing surface.

The invention applies, in a particularly advantageous way, to a switching device consisting of a limiting contactor comprising a switching module, a removable indirect switching control module and a direct switching control module (removable or incorporated in the switching module).

In this case, the purpose of the safety device will be to prevent any possibility of assembling (or removing) the indirect switching control module, not only when this module is not in the set condition but also when the direct switching control module is enabled to operate.

To attain these results, the safety device of the invention further includes a safety switch mounted in series in the supply circuit for the coil of the electromagnet of the direct switching control module, as well as means for controlling this switch as a function of the position of the manual control member of the control module. This indirect switching control module may then have, in addition to the tripped position and the transitory setting position, two set positions, namely :

a "stop" position, and an "auto" position.

In this case, said control means will be designed so as to close the safety switch only in the "auto" position whereas the prevention means will be provided so as to allow access to the head of the screw only when these control means are in the "stop" position.

BRIEF DESCRIPTION OF THE DRAWINGS

An embodiment of the invention will be described hereafter, by way of non limitative example, with reference to the accompanying drawings in which.

DESCRIPTION OF THE PREFERRED EMBODIMENTS

Figure 1:
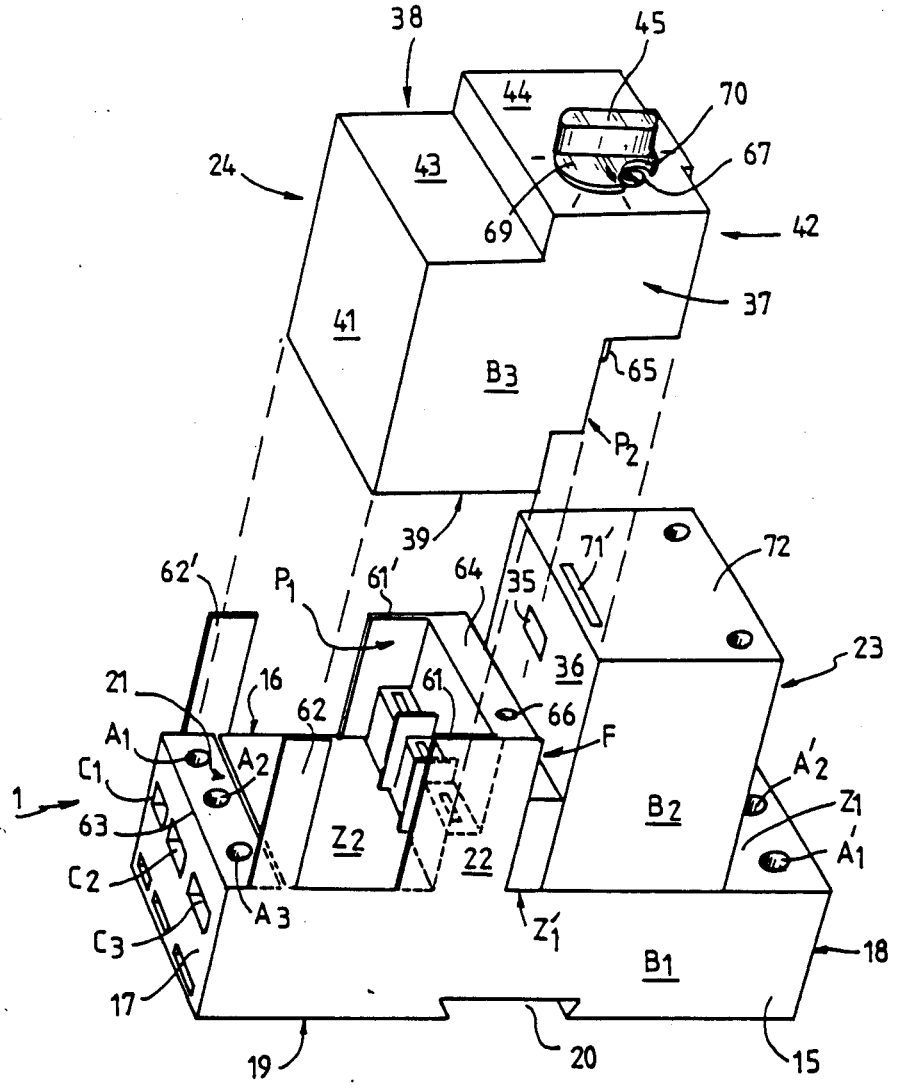
FIG. 1 shows in schematic perspective a limiting contactor equipped with a device in accordance with the invention, in the disassembled condition.
Figure 2:
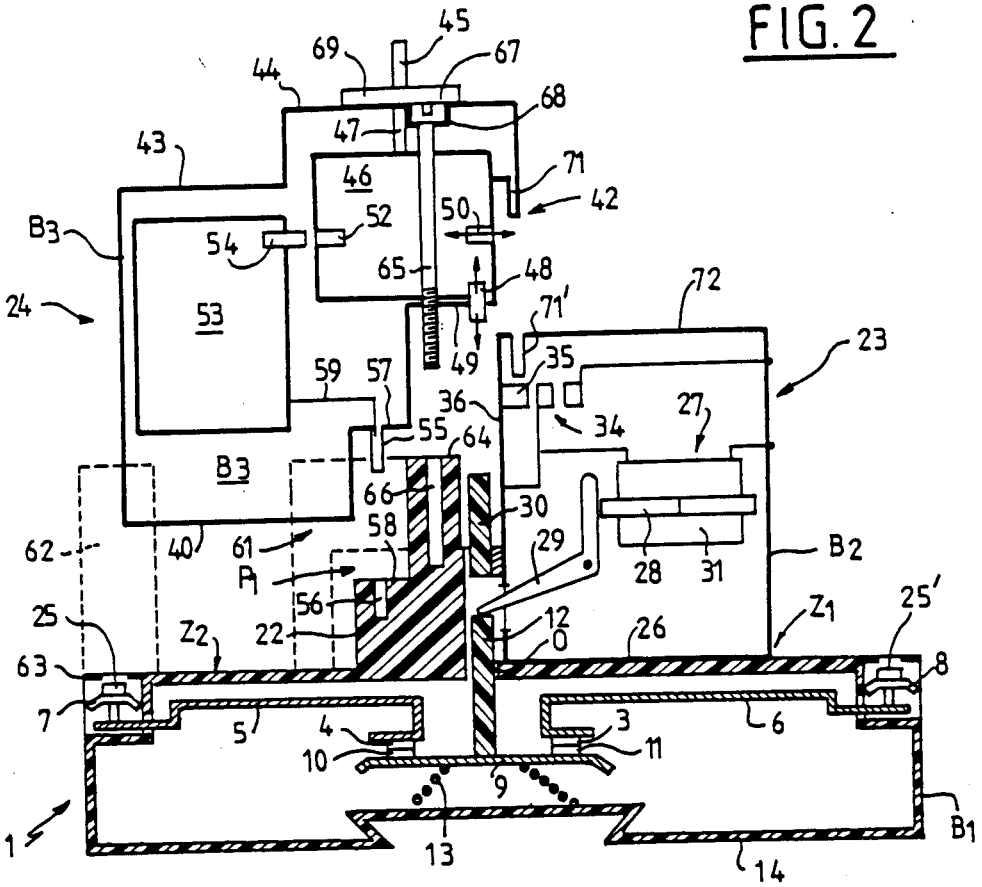
FIG. 2 is a schematic side view, partially in section, of the contactor shown in FIG. 1.

In this example, the limiting contactor is formed first of all of a switching module 1 comprising, inside a case $B_1$ three power switching devices of a normally open type, only one of which is visible in FIG. 2 and each of which comprises :

- two fixed contact elements 3, 4 carried by two conductors 5, 6 connected respectively to two connectors 7, 8;
- a mobile assembly comprising a mobile contact holder 9 made from an electrically conducting material and on which are mounted two mobile contact elements 10, 11 for cooperating with the fixed contact elements 3, 4 respectively;
- an operating member consisting of a pusher 12 made from an electrically insulating material, fast with the mobile contact holder 9;
- a spring 13 disposed between the support wall 14 of case 2 and the mobile contact holder 9 so as to exert a force tending to apply the mobile contacts 10, 11 against the fixed contacts 3, 4.

Of course, this switch, which is shown very schematically, may further comprise all the equipment with which switches are usually provided, such for example, as arc splitting fins, decompression channels, etc...Furthermore, conductors 5 and 6 have a bent form permitting the development of repulsion forces acting on the mobile contact holder 9 under the effect of the current flowing through the switch.

More precisely, case $B_1$ has an elongate shape of a general substantially parallelepipedic trend and comprises:

- two parallel opposite longitudinal faces 15, 16 which play the role of junction faces in the case of an assembly of several modules 1 disposed side by side ;
- two opposite lateral faces 17, 18;
- a support face 19 which comprises, in its middle portion, a prismatic concavity 20, of trapezoidal section, extending perpendicularly to the longitudinal faces 15, 16, which serves for mounting case 2 on a profiled support rail of conventional type ; and
- an assembly face 21 opposite the support face 19.

This assembly face 21 has, in its middle portion, a dividing wall 22 which extends perpendicularly to the longitudinal faces 15, 16 and to the assembly face 21. This dividing wall 22 separates the assembly face 21 into two zones, namely a zone $Z_1$ intended to receive a direct control module 23 and a zone $Z_2$ intended to receive an indirect control module 24. It comprises, on the assembly zone $Z_2$ side, a stepped profile $P_1$ and, on the zone $Z_1$ side a flat face F perpendicular to the assembly face 21.

Zone $Z_1$ comprises, in the vicinity of dividing wall 22, three orifices 0 aligned perpendicularly to the longitudinal faces 15, 16, through which the pushers 12 of the three switches pass. Furthermore, the lateral faces 17, 18 each have three orifices $C_1$, $C_2$, $C_3$ giving access to the connection devices 7, 8 whose clamping screws 25, 25' are accessible through corresponding orifices $A_1$, $A_2$, $A_3$, $A'_1$, $A'_2$ provided in the assembly face 21.

The direct control device 23 comprises a case $B_2$ of a parallelepipedic shape fixed by its base 26 to the assembly zone $Z_1$ set back slightly from zone $Z'_1$ into which pushers 12 emerge.

This case $B_2$ contains an electromagnet 27 whose mobile armature 28 (or the core) is connected to a lever 29 for actuating the pushers 12 of the switches. In this example, the end of lever 29 situated opposite its connection to armature 28 cooperates with a rake 30 movable in translation in the gap between case $B_2$ and dividing wall 22 and supported by the pushers 12 of the three switches. Lever 29 and rake 30 are then disposed so that energization of the coil of the electromagnet 27 causes lever 29 to swing which causes a translational movement of rake 30 and of the three pushers 12, against the action exerted by springs 13, in the direction for opening the contacts 3, 4–10, 11.

Energization of coil 31 of the electromagnet is caused through a remote control circuit connected to two terminals 32, 33 provided on case $B_2$ and comprising a switch 34 disposed in series.

This switch 34 is controlled by a pusher 35 accessible through an opening provided in the face 36 of case $B_2$ situated opposite the dividing wall 22.

The indirect switching control module 24 is in the form of a case $B_3$ of prismatic shape with rectangular cross section having :

- two opposite flat longitudinal faces 37, 38 parallel to each other and separated from each other by a distance substantially equal to that of the longitudinal faces 15, 16 of the switching module 1;
- an assembly face 39 which extends perpendicularly to the longitudinal faces 37, 38 and which has a base 40 intended to come opposite the assembly zone $Z_2$, as well as a stepped profile region $P_2$ of a shape substantially complementary to that of the stepped profile $P_1$ of dividing wall 22;
- two opposite parallel lateral faces 41, 42 one, 41, of which, situated on the stepped profile $P_2$ side, is intended to come jointingly against the face 36 of the direct control module 23; and
- a front face 43 having a step 44 on which is mounted a rotary resetting control knob 45.

In this example, the indirect switching control module 24 comprises both a tripping device with potential accumulation and the protection devices which are associated therewith such, for example, as an electromagnet causing tripping of the device in response to sudden current surges or short circuits, a thermal protection system, for example, including bimetal strips for causing tripping following abnormal current rises extended in time.

In FIG. 2, the tripping device 46 has been shown schematically by a block into which the shaft 47 of the resetting control knob 45 penetrates and which comprises two actuating members, namely :

- a first actuating member 48 represented by a pusher, passing through an orifice provided in step 49 of case $B_3$, at a position situated in line with rake 30 when module 24 is assembled with the switching module 1, and
- a second actuating member 50 shown by a pusher, passing through an orifice provided in the lateral face 42 of the case $B_3$ at a position situated opposite pusher 35 of the direct switching control module 23, when the two modules 23, 24 are assembled to module 1.

The first actuating member 48 may assume two positions, namely :

- a retracted position which corresponds to the set condition of the tripping module (and to the "stop" and "auto" positions of knob 45), in which position this member 48 exerts no action on rake 30 so as to allow the power switching devices of module 1 to pass to their normally closed positions, and
- following tripping, an opened out position in which it bears on rake 30 so as to maintain the power switches open.

The second actuating member 50 may also assume a retracted position in which it is not urged by pusher 35 and an opened out position in which it acts on pusher 35 so as to close the switch 34 of the control module 23, the passage from the retracted position to the opened out position taking place by causing the knob 45 to pass from the "stop" position (i.e. setting) to an "auto" position.

The tripping device 46 further comprises a tripping member 52 represented here by a pusher which, when it is urged, causes the first actuating member 48 to pass suddenly from its retracted position to its opened out position.

The protection devices 53 associated with the tripping device 46, which are here housed in the indirect switching module 24, have been shown schematically by a block in FIG. 2.

They comprise an actuating member 54, represented by a pusher, disposed so as to urge the tripping member 52 following detection of an anomaly of the current passing through the power switches of module 1.

The electric connections between the current lines passing thorough these power switches and these protection devices 53 are formed by three pairs of male 55 and female 56 connecting elements provided respectively on steps 57, 58 facing modules 1 and 23; the male connecting elements 55 are connected to the protection devices 53 through connections 59, whereas the female connecting devices 56 are connected respectively to the conductors 5 of the power switches.

Of course, the male connecting elements 55 are designed so as to engage in the female connecting elements 56 when the indirect switching module 24 is assembled with the switching module 1.

In should be noted in this connection that this assembly is formed by fitting module 24 on module 1 following a translational movement perpendicular to the assembly face 21.

During this translational movement, module 24 is guided by means of guide fins 61, 62 - 61', 62' which extend the longitudinal faces 15, 16 in regions adjacent the dividing wall 22 and the transverse edge 63 and end at the height of the upper step 64 of dividing wall 22.

The indirect switching control module 24 is fixed to the switching module 1 by means of at least one screw 65 which is engaged in a through passage of case $B_3$ so as to screw, in the assembled position of modules 1 and 24, into a tapped bore 66 provided in step 64 of dividing wall 22, the axis of screw 65 and that of bore 66 being perpendicular to said step 64.

In this example, the head 67 of screw 65 is engaged in a well 68 formed in step 44 of the front face 43 in the rotational area of collar 69 of the setting knob 45.

It is clear that at the end of screwing in, head 67 of screw 65 bears against the bottom of well 68 so as to provide clamping of the two modules 1, 24.

To permit screwing, the collar 69 of knob 45 has an indentation 70 disposed so as to coincide with well 68 only when knob 45 is in the "stop" position. Thus, when the knob is not in the "stop" position, it is then impossible to disassemble modules 1 and 24 or, on the contrary, assembly them.

Furthermore, because of the guide fins 61, 61' - 62, 62' and because the head 67 of screw 65 is imprisoned in well 68 by the collar 69 of knob 45, an attempt to assemble the two modules 1, 24 cannot lead to accidental actuation of the power switches; module 24 will be held away from module 1 by screw 65.

Preferably, the length of the portion of screw 65 projecting from module 24 will be greater than the length of the stroke of the actuating member 48, so that the latter cannot come to bear on the rake 30 during such an attempt.

In another embodiment, screw 65 may be urged axially by a spring so that, in the unscrewed position, it remains engaged in the indentation 70 and thus prevents any operation of knob 45.

Module 24 is secured to module 23 by a tongue 71, integral with case $B_3$, which extends parallel to the lateral face 42 from step 44 and which is engaged in a slit provided in face 72 of case $B_2$ This arrangement avoids in particular separation of cases $B_2$ and $B_3$ under the effect of the pressure exerted by the actuating member 50 on pusher 35.

The operation of the above described device will be explained hereafter in connection with FIGS. 3 to 6 which show the setting knob 45 in its different positions of use.

In the "stop" position of knob 45, indentation 70 of collar 69 coincides with well 68 and head 67 of screw 65 is accessible, either for assembly or for disassembly. In this position, the actuating members 48, 50 are in the retracted condition and module 24 is in the set condition. This module exerts no action on the switching module 1 and the direct switching module 23 is inhibited because switch 34, which is not urged, is in the open condition.

Figure 4:
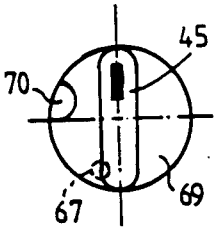

From this position, passage to the "auto" position shown in FIG. 4 (clockwise rotation through 90° ) causes the opening out of the actuating member 50 which then acts on pusher 35 so as to cause closure of contact 34. The direct switching control module 23 is then enabled to operate. Collar 69 prevents access to the head 67 of screw 65.

Figure 5:
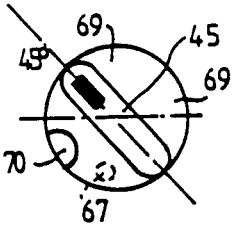

When the tripping member 52 is urged by the protection devices 53, it causes the actuating member 48 to pass to the opened out position thus causing opening of the power switches of module 1. During tripping, knob 45 effects a rotation through 45° in an anti-clockwise direction, in which position collar 69 prevents access to head 67 of screw 65 (FIG. 5).

Figure 3:
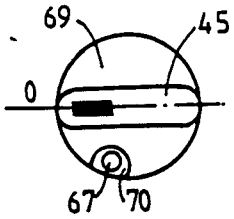
FIGS. 3, 4, 5 and 6 are views of the upper face of the indirect control module, with a setting control knob in the "stop"(FIG. 3), "auto" (FIG. 4), "tripped" (FIG. 5) and "setting" (FIG. 6) positions.
Figure 6:
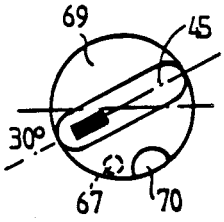

Resetting is then achieved by rotating knob 45 through 75° in an anti-clockwise direction as far as the "setting" position shown in FIG. 6, then bringing the knob (clockwise direction) back to the "stop" position shown in FIG. 3. The knob may then be brought back to the "auto" position of FIG. 4.

Such as described above, the device of the invention makes it possible to obtain very great safety, while being very simple and without constraint for the user.

What is claimed is:

1. A switch device for switching appliances comprising the assembly of at least first and second removable modular elements, the first modular element being a switching module comprising at least one power switch having at least one fixed contact element, at least one mobile contact element, mounted on a mobile assembly so as to be able to take up at least an open position and a closed position, and resilient means exerting on the mobile assembly a force tending to bring the mobile contact element back into one of said positions, the second modular element being an indirect switching control module having at least first and second stable conditions, the first stable condition being a set condition and the second stable condition being a tripped condition, said second modular element further having first and second transitory phases, the first transitory phase being a setting phase and the second transitory phase being a tripping phase, said control module comprising means adapted for accumulating an amount of potential energy transmitted by a setting member during the setting phase and tripping means for applying this potential energy to a member actuating the mobile assembly during the tripping phase in response to a tripping order, said switch device further comprising fixing means for fixing said control module to said switching module, said fixing means comprising at least one screw mounted for axial sliding in a through passage provided in said control module, so that in the assembled position of the control module on the switching module it may be screwed into a tapped bore formed in the switching module for clamping the first and second modular elements together, said switching device further comprising prevention means preventing access to the head of the screw and, consequently, any possibility of screwing this screw in or out, when the control module is not in the set condition; said switching module further comprising guide means cooperating with corresponding guide means provided on the control module so that the first and second modular elements can only be assembled together after a relative translational movement parallel to the axis of said screw.

2. A switch device as claimed in claim 1, wherein said prevention means are fast with said setting member.

3. A switch device as claimed in claim 1, wherein said prevention means are designed so as to provide axial blocking of the screw when said control module is not set and, in this case, the length of the threaded end of said screw which screws into said tapped bore is at least equal to the distance travelled by the control module for actuating said mobile assembly.

4. A switch device as claimed in claim 1, wherein said translational movement takes place over a path of a length at least equal to the length of the end of the screw which projects outwardly of said control module when said screw is blocked axially by said prevention means.

5. A switch device as claimed in claim 1, wherein said setting member consists of a rotary knob and said prevention means consist of a circular sector fast for rotation with said knob, said sector being disposed so as to cover the head of the screw when the control module is not in the set condition.

6. A switch device as claimed in claim 5, wherein said sector consists of a collar carried by the knob and having an indentation permitting access to the head of the screw when the knob is not in the set position.

7. A switch device as claimed in claim 6, wherein said screw is urged axially by a spring disposed so that, in the unscrewed position, said screw remains engaged in said indentation and thus prevents operation of the knob.

8. A switch device as claimed in claim 1, in which the switching appliance further includes a direct control module of the type comprising an electromagnet adapted to cause a change of condition of the switching module by exerting on said mobile assembly an action antagonistic to that of said resilient means, further comprising a safety switch mounted in series in the supply circuit of the coil of the electromagnet as well as means for controlling this switch as a function of the position of the member for manually resetting the indirect switching control module.

9. A switch device as claimed in claim 6, wherein said manual resetting member may assume successively:

i a "stop" position in which the indirect switching control module is in the set condition whereas said safety switch is open;

ii an "auto" position in which the indirect switching control module is in the set condition and acts on the direct switching control module for maintaining said safety switch closed;

iii a tripped position in which the indirect switching control module acts on said power switch for maintaining it open, said safety switch being also open; and iv a transitory "setting " position which is reached during a setting stroke effected from the tripped position and following which said resetting member comes back to the "stop" position;

and in this case, said prevention means only permit access to the head of the screw when said resetting member is in said "stop" position.

10. A switch device as claimed in claim 8, wherein for actuated said safety switch, said indirect switching control module comprises an actuating member adapted for exerting on said control member of said safety switch a force directed perpendicularly to the axis of said screw and, in this case, said direct and indirect switching control modules comprises respective engagement means which are engaged one in the other at the end of the travel for assembling the indirect switching control module on the switching module.

* * * * *